US006300551B1

(12) United States Patent
Adinolfi

(10) Patent No.: US 6,300,551 B1
(45) Date of Patent: Oct. 9, 2001

(54) ACOUSTICAL DRUM SHELL STAGED BRIDGE REINFORCEMENT STRUCTURE

(76) Inventor: Alfonso M. Adinolfi, 607-18th Ave. East, Seattle, WA (US) 96112

( * ) Notice: Subject to any disclaimer, the term of this patent is extended or adjusted under 35 U.S.C. 154(b) by 0 days.

(21) Appl. No.: 09/491,473

(22) Filed: Jan. 19, 2000

(51) Int. Cl.[7] ..... G10D 13/02
(52) U.S. Cl. ..... 84/411 R; 84/416; 84/417
(58) Field of Search ..... 84/411 R, 415, 84/416, 417, 418, 419

(56) References Cited

U.S. PATENT DOCUMENTS 1,420,233 * 6/1922 Baldwin et al. ..... 84/411 R
3,911,779 * 10/1975 Della-Porta ..... 84/411 R
4,993,304 * 2/1991 Lovelet ..... 84/411 R
5,330,848 * 7/1994 Kluczyski et al. ..... 428/537.1

* cited by examiner

*Primary Examiner*—Shih-Yung Hsieh
(74) *Attorney, Agent, or Firm*—Graybeal Jackson Haley LLP

(57) ABSTRACT

A transitionally reinforced drum shell for an acoustical drum of the type having drumhead tensioning hardware is disclosed herein. The invention comprises a staged bridge reinforcement structure incorporated on the inside of the shell, which provides structural support for the drumhead tensioning hardware while enhancing the tonal quality of the instrument. The transitions may be accomplished with abrupt steps or smooth tapers between thickness regions. Also disclosed are a non-integrated staged bridge reinforcement structure, which can be retrofitted to existing drum shells, and a method of reinforcing axial regions of a drum shell with such a staged bridge reinforcement structure.

24 Claims, 2 Drawing Sheets

ACOUSTICAL DRUM SHELL STAGED BRIDGE REINFORCEMENT STRUCTURE

TECHNICAL FIELD

The present invention pertains generally to acoustical drums and more particularly to a reinforced drum shell structure for receiving a tunable head.

BACKGROUND

Acoustical drums are usually constructed with a cylindrical body, or shell, at least one tunable drumhead, and tensioning hardware. The drum shell is typically constructed from multiple-ply wood such as maple. However, to achieve the maximum projection, volume, and focus, drum shells (especially snare drum shells) are often made of brass or steel.

Depending upon the type of drum, the drum shell may have two batter ends, each of which is fitted with a tunable drumhead. However, for snare and tom drums, the drum shell typically has a batter end and a non-batter end. The batter end may be reinforced for mounting the tunable drumhead and the tensioning hardware, which one uses to adjust the tonal quality of the complete drum assembly. The non-batter end may also be reinforced in the same way.

Typically, the reinforcement is a uniformly thick band of wood along the inside or outside of the cylindrical wood shell at one end and extending a distance along the shell wall toward the opposite end. The resulting structure, although certainly an improvement upon a non-reinforced drum shell, often lacks the necessary structural integrity to support a wide range of tonal adjustment. Specifically, upon tightening of the tunable drumhead, the reinforced batter end of the shell may warp or collapse, resulting in a loss of circular symmetry, thus having a "choking" or muting effect which impairs resonance and degrades the drum's overall tonal quality.

Although many of the desired effects, e.g., increased structural integrity, as well as maximum projection, volume, and focus of sound, can be achieved by the use of a metal such as brass or steel instead of wood for the drum shell, it is widely known that such shells lose the flexibility and tonal warmth of a thin-walled wood shelled drum.

Attempts to remedy this problem by building wood-shelled drums with walls of uniformed thickness have achieved, to some extent, the volume and focus but still lack the flexibility of varied tuning and the warmth of tone and resonance that a thin-walled wood shell drum offers. Such drums are considered "one-dimensional" and are, as a rule, used as specialty drums for occasional performance or recording.

SUMMARY OF THE INVENTION

One aspect of the present invention is directed to a drum shell that includes at least one staged bridge reinforcement structure along its length. The reinforcement structure(s) strengthens the drum shell such that the drum shell can support a wide range of head tension adjustment without warping. In addition, the staged bridge design of the reinforcement structure helps to achieve the best tonal qualities of both metal and wood drums while enhancing the structural integrity and eliminating distortion throughout the head tension adjustment range.

A staged bridge reinforcement structure is typically used on wood drums to achieve the projection, volume, and focus of metal drums while retaining the warmth, resonance, and tonal quality of wood drums. Such a staged bridge reinforcement structure, however, may be used on a drum shell of any material, and furthermore may be used on a drum shell with two batter ends or on a drum shell with a batter end and a non-batter end.

One embodiment of the staged bridge reinforcement structure is used on a snare-type drum and includes a built-up structure that begins at the batter end of a drum shell, extends axially along the shell, and terminates at a distance from the non-batter end. The built-up structure is disposed along the inside of the drum shell and may be abruptly stepped or smoothly tapered. In addition, the built-up structure is constructed of multiple plies of wood or some other applicable material, and the multiple plies are laminated to one another.

The thicknesses of the built-up regions, as well as the number of regions, the placements thereof, and other design features will vary depending upon the individual shell length and the tonal objectives of the designer. The staged bridge reinforcement structure may include any number of different thicknesses in any order and may begin at the batter end or the non-batter end.

A preferred embodiment of a snare-type drum assembly includes a drum shell having a stepped staged bridge reinforcement structure disposed along the batter end of the drum shell, a drumhead extending across the batter end of the shell, and tightening hardware. In addition to the stepped staged bridge structure at the batter end of the shell, there is a short built-up region at the non-batter end of the shell for structural support. The overall stepped design of the stepped staged bridge reinforcement structure incorporates an intermediate axial region with nominal wall thickness for retaining resonance. Furthermore, the drum shell is preferably constructed of several plies of maple, but another wood or different type of material can be used.

Although with snare-type drums, there is typically a batter end and a non-batter end with the staged bridge reinforcement structure commencing at the batter end and extending toward the non-batter end, it is to be understood that on a drum having two batter ends, there can be a staged bridge reinforcement structure commencing at each batter end and extending toward the opposite end. Likewise, on a drum having a batter end and a non-batter end, there can be a staged bridge reinforcement structure commencing at the non-batter end and extending toward the batter end.

The specific type of tightening hardware used is not pertinent to the invention and may be any conventional hardware that operates to adjust the tension of the drumhead, while it is attached to the drum shell, in order to adjust the tonal quality of the drum.

The various embodiments of the invention are revolutionary because they utilize varied and "deliberately staged" thicknesses on either end of the shell to achieve not only the "pop," volume, and focus of the metal shells but also the warmth, resonance, open tonal quality of a thin-walled, wood shell drum. In addition, the design enhances the ability to tune above and below the "sweet spot" of the drum, allowing for a wider range of tuning flexibility and open dynamics.

The "sweet spot" of the drum is defined as that point at which tensioning of a stretched drumhead causes an ovalling and inward collapse of a drum shell bearing edge. Tensioning beyond the "sweet spot" results in an exaggerated "choking" or muting effect and consequently the loss of resonance, tonal quality and projection. Such characteristics are normally associated with poor drum performance.

The incorporation of the described construction makes this drum a more useful and desirable tool for those who engage in the various aspects of the percussive arts.

DETAILED DESCRIPTION OF THE INVENTION

Figure 1:
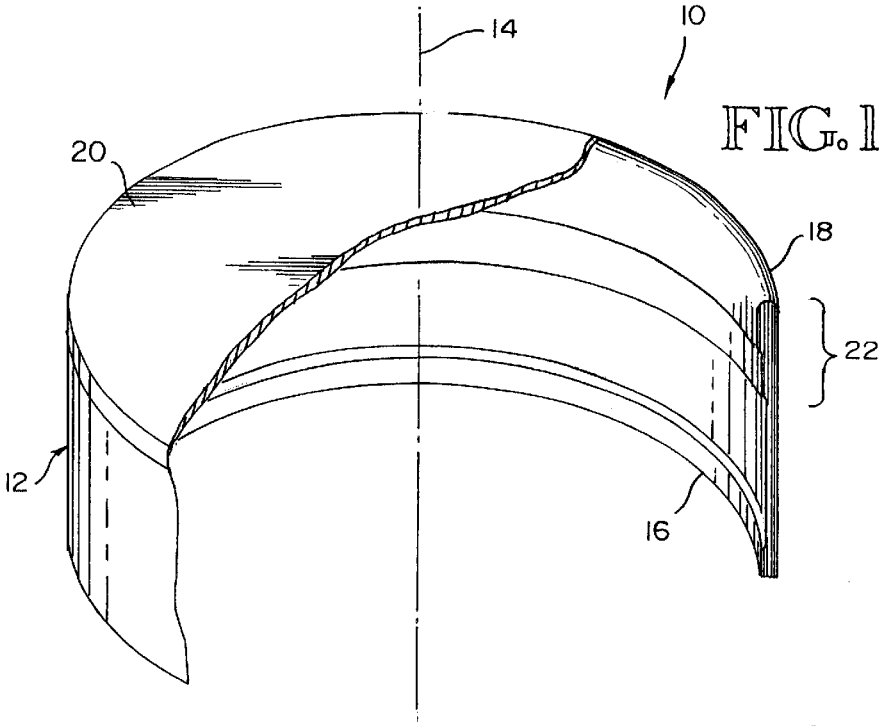
FIG. 1 is a perspective view of an acoustical drum having a drum shell that includes a staged bridge reinforcement structure according to an embodiment of the invention.

FIG. 1 illustrates an embodiment of the invention comprising an acoustical drum 10 having an approximately cylindrical shell 12. The shell 12 has an axis of symmetry 14, a non-batter end 16, and a batter end 18, across which is stretched and mounted a drumhead 20. The shell 12 includes a staged bridge reinforcement structure 22, which protrudes inwardly from the shell 12 toward the axis 14. Conventional drum head tightening hardware is omitted from FIG. 1 for clarity. In one embodiment, the drum shell 12 has a diameter of approximately 12–14 inches, a height of approximately 6.5 inches, and is made of multiple-ply wood such as maple, birch, mahogany, poplar, or alder, wherein the plies are bonded to one another with an appropriate adhesive. Furthermore, in one embodiment, the batter end 18 of the drum shell 12 is rounded so as to accept the drumhead 20 and the tightening hardware (not shown). Alternatively, the batter end 18 may be squared. Similarly, the non-batter end 16 may be rounded or squared.

Figure 2:
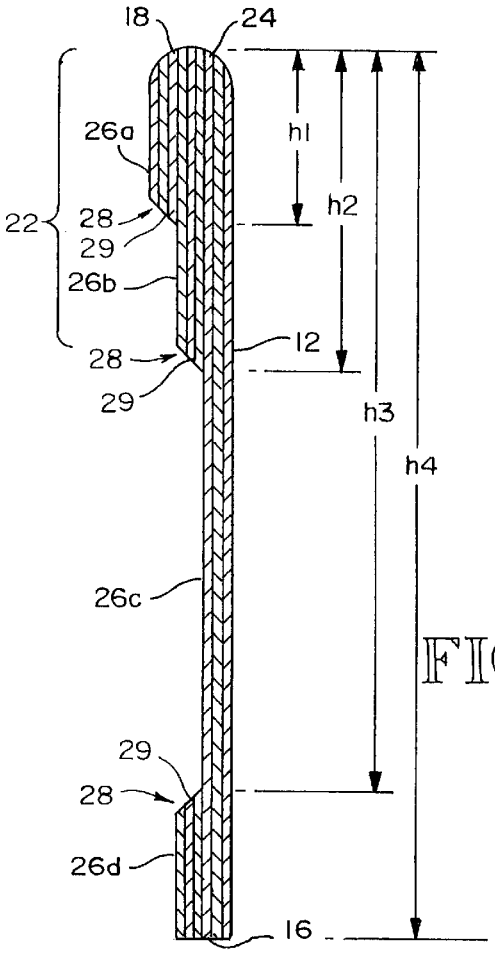
FIG. 2 is a cross-sectional view of the wall and staged bridge reinforcement structure of the drum shell of FIG. 1 according to an embodiment of the invention.

FIG. 2 is a cross-sectional view of the shell 12 according to an embodiment of the invention. The shell 12 is constructed of several plies 24 of maple wood laminated and bonded to one another. In one embodiment, the staged bridge reinforcement structure 22 is of a stepped construction and thus includes a region 26*a* of greatest thickness and a region 26*b* of secondary thickness. In some embodiments, the staged bridge reinforcement structure 22 extends at least ⅓ of the axial dimension of the drum shell. The shell 12 also includes a region 26*c* of nominal thickness and a built-up terminal region 26*d*. The ranges of thicknesses and heights of each region 26*a*, 26*b*, 26*c*,and 26*d* (collectively referred to as regions 26) as well as the number of plies 24 recommended are in accordance with the following table, wherein one ply 24 is approximately 0.0275 inches thick:

| Region | Thickness | Height (h) | Plies |
|---|---|---|---|
| 26a | .2475–.4675 | 0.75–1.00 inch (h1) | 9–17 |
| 26b | .1650–.3300 | 2.00 inch (h2) | 6–12 |
| 26c | .0825–.1650 | 3.25–3.50 inch (h3) | 3–6 |
| 26d | .1650–.4675 | 0.50 inch (h4) | 6–17 |

Still referring to FIG. 2, the region of greatest thickness 26*a* is adjacent to the batter end 18 and extends axially as far as is necessary for adequately supporting the batter end 18 of the shell 12, particularly when hoop stress is applied by the tensioning hardware (not shown). Then the region of secondary thickness 26*b* extends therefrom, providing an appropriate transition into the region of nominal thickness 26*c*, which has the greatest extent of all the regions, for resonance purposes.

In one embodiment, the steps 28 between the regions 26 are not absolutely abrupt, but instead are angled at approximately 45 degrees. Using fillets 29 in this way, the steps 28 are reinforced such that there are relatively abrupt transitions between the regions 26 for tonal quality, but there is a relatively small likelihood of stress cracking at the edges and comers of the steps 28.

In addition, in this embodiment, there is the built-up terminal region 26*d* adjacent the non-batter end 16 of the shell 12. This region 26*d* is the shortest region 26 of the shell 12, and adds structural support to the non-batter end 16 of the drum shell 12.

Also in this embodiment, maple plies 24 each of approximately 0.0275 inches thick are laminated into a generally cylindrical structure of 3 plies to form the basic drum shell 12. The plies 24 of the reinforcement structure 22 are then bonded to the inside of the shell 12 to increase the thickness and strength according to the number of plies 24 added. As a retrofit to an existing acoustical drum (not shown), an appropriate staged bridge reinforcement structure 22 can be bonded to the inside of the drum shell.

Alternatively, on a drum shell having two batter ends, there could be a region of greatest thickness at each end and built-up regions of decreasing thicknesses extending toward the middle of the shell. However, in this application, it is not necessary that the shell wall be symmetrical; the design can vary according to the tonal and structural goals of the designer.

Figure 3:
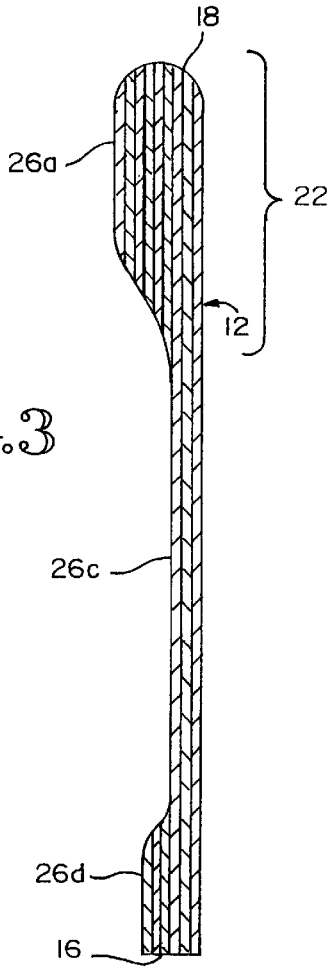
FIG. 3 is a cross-sectional view of the wall and staged bridge reinforcement structure of the drum shell of FIG. 1 according to another embodiment of the invention.

FIG. 3 is a cross-sectional view of another embodiment of the staged bridge reinforcement structure 22, which has a gradual curved taper between the structure 22 and the region 26*c*. The region of greatest thickness 26*a* at the batter end 18 extends axially as far as is necessary for adequately supporting the batter end 18 of the shell 12, particularly when hoop stress is applied by the tensioning hardware (not shown). However, the transition from this region 26*a* to the region of nominal thickness 26*c* is a smooth and gradual taper. The region 26*b* is omitted in this embodiment. After a substantial extent (for resonance purposes) of the region of nominal thickness 26*c*, the shell 12 tapers inward to the terminal region 26*d*, which in this embodiment is again the shortest region 26 of the shell 12.

Figure 4:
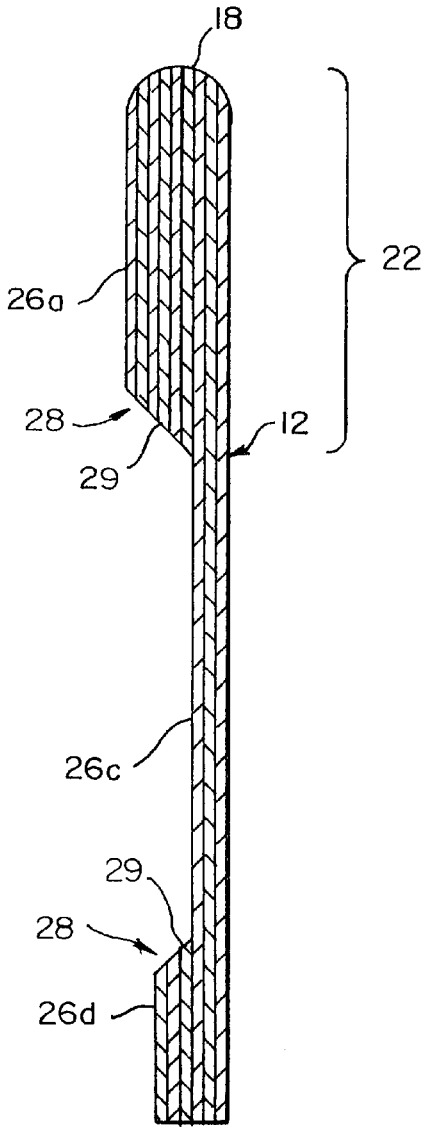
FIG. 4 is a cross-sectional view of the wall and staged bridge reinforcement structure of the drum shell of FIG. 1 according to another embodiment of the invention.

FIG. 4 is a cross-sectional view of yet another embodiment of the staged bridge reinforcement structure 22, which is similar to the structure 22 of FIG. 2 except the region 26*b* is omitted and the region 26*c* is lengthened. The region of greatest thickness 26*a* begins adjacent the batter end 18 and extends axially as far as the region of nominal thickness 26*c*, where it steps down at approximately 45 degrees. The region of nominal thickness 26*c* then extends a substantial distance (for resonance purposes) before transitioning into the terminal region 26*d*. The steps 28 are angled and filled as previously discussed in conjunction with FIG. 2.

Figure 5:
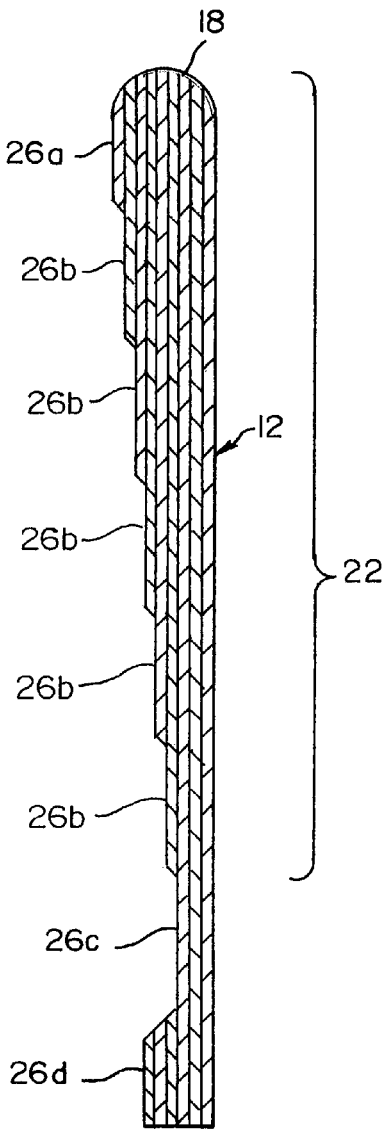
FIG. 5 is a cross-sectional view of the wall and staged bridge reinforcement structure of the drum shell of FIG. 1 according to another embodiment of the invention.

FIG. 5 is a cross-sectional view of yet another embodiment of the staged bridge reinforcement structure 22. Specifically the structure 22 has multiple stepped regions 26*b*. The region of greatest thickness 26*a* is shorter than in previous embodiments but must still extend axially as far as is necessary for adequately supporting the batter end 18 of the shell 12, particularly when hoop stress is applied by the tensioning hardware (not shown). The transition structure 22 steps down, in a series of shallow stepped regions 26*b*, to the region of nominal thickness 26*c* and ends at the non-batter end 16 with the built-up terminal region 26*d*.

It is to be understood that even though various embodiments and advantages of the present invention have been set forth in the foregoing description, the above disclosure is illustrative only, and changes may be made in detail, and yet remain within the broad principles of the invention. Therefore, the present invention is to be limited only by the appended claims.

What is claimed is:

1. A reinforced acoustical drum, comprising:

a drum shell having at least one batter end and an opposite end;

a reinforcement structure commencing at one end of the drum shell, extending axially along the shell, and including at least two regions of different thicknesses before transitioning to a region of nominal thickness, and a drumhead mounted to the batter end.

2. The drum of claim 1 wherein the reinforcement structure comprises a region of greatest thickness at the batter end of the drum shell and regions of decreasing thicknesses with axial extent away from the batter end.

3. The drum of claim 1 wherein the reinforcement structure comprises abruptly stepped transitions between the regions of different thicknesses.

4. The drum of claim 3 wherein the reinforcement structure further comprises fillets between the stepped transition regions.

5. The drum of claim 1 wherein the reinforcement structure comprises smoothly tapered transitions between the regions of different thicknesses.

6. The drum of claim 1 wherein the reinforcement structure extends at least ⅓ of the axial dimension of the drum shell.

7. A reinforced acoustical drum comprising:

a hollow, generally cylindrical drum shell having a batter end, a non-batter end, an inside, a geometrical axis of symmetry, a diameter, an axial dimension, and a nominal thickness, such drum shell being constructed of several plies of wood bonded to one another;

a built-up reinforcement structure on the inside of the drum shell commencing at the batter end, extending axially along the shell for at least ⅓ of the axial extent of the drum shell, and terminating before reaching the non-batter end, such reinforcement structure comprising regions of different thicknesses with axial extent along the shell and such reinforcement structure being constructed of plies of wood bonded to the drum shell; and a drumhead stretched across and mounted onto the batter end.

8. The drum of claim 7 wherein the nominal thickness of the drum shell is 3–6 plies thick.

9. The drum of claim 8 wherein the reinforcement structure comprises a region of greatest thickness at the batter end of the drum shell and regions of decreasing thicknesses with axial extent away from the batter end.

10. The drum of claim 9 wherein the reinforcement structure comprises a region of secondary thickness adjacent the region of greatest thickness.

11. The drum of claim 10 wherein the region of greatest thickness is approximately 9–17 plies thick and the region of secondary thickness is approximately 6–12 plies thick.

12. The drum of claim 11 wherein the drum shell has a terminal region of built-up thickness at the non-batter end.

13. The drum of claim 12 wherein the terminal region is approximately 6–17 plies thick.

14. A staged bridge reinforcement structure for a drum shell, comprising a generally cylindrical ring of material having a first end, an inside, an outside, a geometrical axis, and axial regions of different thicknesses that together form a stepped construction of the staged bridge reinforcement structure, such ring being capable of being coaxially bonded to the inside of an existing drum shell.

15. The reinforcement structure of claim 14 wherein the outside of the ring is of a constant diameter and the different thicknesses of the ring are directed inside toward the geometrical axis of the ring.

16. The reinforcement structure of claim 15 wherein the cylindrical ring has stepped transitions between the regions of different thicknesses.

17. The reinforcement structure of claim 15 wherein the cylindrical ring has smoothly tapered transitions between the regions of different thicknesses.

18. A method of reinforcing axial regions of a drum shell with a staged bridge reinforcement structure having axial regions of different thicknesses, comprising the steps of:

determining the location of the axial regions of the drum shell to be reinforced, forming a stepped construction of the staged bridge reinforcement structure, and bonding the staged bridge reinforcement structure to the drum shell at the axial regions thus determined.

19. The method of claim 18 wherein the reinforcement structure is constructed of a plurality of wood plies.

20. The method of claim 19 wherein the wood plies are bonded to one another and to the drum shell using an appropriate wood glue.

21. A reinforced acoustical drum, comprising:

a drum shell having at least one batter end and an opposite end;

a reinforcement structure commencing at one end of the drum shell, extending axially along the shell, and including regions of different thicknesses; a drumhead mounted to the batter end; and wherein the reinforcement structure comprises abruptly stepped transitions between the regions of different thicknesses.

22. The drum of claim 21 wherein the reinforcement structure further comprises fillets between the stepped transition regions.

23. A reinforced acoustical drum, comprising:

a drum shell having at least one batter end and an opposite end;

a reinforcement structure commencing at one end of the drum shell, extending axially along the shell, and including regions of different thicknesses;

a drumhead mounted to the batter end; and wherein the reinforcement structure extends at least ⅓ of the axial dimension of the drum shell.

24. A staged bridge reinforcement structure for a drum shell comprising:

a generally cylindrical ring of material having a first end, an inside, an outside, a geometrical axis, and axial regions of different thicknesses, such ring being capable of being coaxially bonded to the inside of an existing drum shell;

wherein the outside of the ring is of a constant diameter and the different thicknesses of the ring are directed inside toward the geometrical axis of the ring; and wherein the cylindrical ring has stepped transitions between the regions of different thicknesses.

* * * * *